US012655600B1

(12) United States Patent
Wang et al.

(10) Patent No.: US 12,655,600 B1
(45) Date of Patent: Jun. 16, 2026

(54) TUBULAR STORAGE AND FILLING DEVICE FOR HYDRAULIC MASS CONCRETE AND ITS APPLICATION

(71) Applicants: Shandong Jiaotong University, Jinan (CN); Shandong Provincial Water Conservancy Engineering Bureau Co., Ltd, Jinan (CN); Qingzhou waterengineering construction limited company, Weifang (CN)

(72) Inventors: Keliang Wang, Jinan (CN); Chuanli Zhong, Jinan (CN); Tao Li, Jinan (CN); Guangtai Gao, Jinan (CN); Ce Li, Jinan (CN); Maozhi Tian, Jinan (CN); Yang Deng, Jinan (CN); Kuo Ma, Jinan (CN); Yang Fang, Jinan (CN); Xiang'an Niu, Jinan (CN); Qinchao Zhang, Jinan (CN); Shuyuan Li, Jinan (CN); Lu Han, Jinan (CN); Gangnian Xu, Jinan (CN); Shengwei Fan, Jinan (CN); Zhide Huang, Jinan (CN); Peigang Jiao, Jinan (CN)

(73) Assignees: Shandong Jiaotong University, Jinan (CN); Shandong Provincial Water Conservancy Engineering Bureau Co., Ltd, Jinan (CN); Qingzhou waterengineering construction limited company, Weifang (CN)

( * ) Notice: Subject to any disclaimer, the term of this patent is extended or adjusted under 35 U.S.C. 154(b) by 0 days.

(21) Appl. No.: 19/264,870

(22) Filed: Jul. 10, 2025

(30) Foreign Application Priority Data

Mar. 3, 2025 (CN) ..... 202510238595.2

(51) Int. Cl.
*E02D 27/40* (2006.01)
*E02D 15/04* (2006.01)
*E02D 27/52* (2006.01)

(52) U.S. Cl.
CPC ..... *E02D 27/40* (2013.01); *E02D 15/04* (2013.01); *E02D 27/52* (2013.01); *E02D 2250/0023* (2013.01)

(58) Field of Classification Search
CPC ..... E02D 15/04; E02D 27/52; E02D 27/40
See application file for complete search history.

(56) References Cited

U.S. PATENT DOCUMENTS 4,266,885 A * 5/1981 Naito ..... E02B 3/10 405/265
4,655,638 A * 4/1987 Waring ..... E02B 3/16 405/152
6,612,779 B1 * 9/2003 Scuero ..... E02B 3/10 405/116

FOREIGN PATENT DOCUMENTS

CN 103882836 A 6/2014
CN 108797630 A * 11/2018 ..... E02D 27/40

(Continued)

*Primary Examiner* — Frederick L Lagman

(57) ABSTRACT

A tubular storage and filling device for hydraulic mass concrete and its application are provided. The device includes an outer tube body, and a bottom end of the outer tube body is connected to a bottom sealing plate defining a discharging port. An interior of the outer tube body defines a storage space for storing materials. A gas pipe is disposed in the outer tube body and is connected to an inflatable and deflatable airbag. The gas pipe is equipped with a switch. The device further includes an inner tube body sleeved within the outer tube body, a supporting piece disposed at the bottom of the outer tube body, and a connecting piece and a pressing piece positioned above the inner tube body for positioning the filling body. The device can be widely (Continued)

applicable to mass concrete projects, enables simultaneous filling during hole formation, broad applicability, and ensures structural integrity.

7 Claims, 12 Drawing Sheets

(56) References Cited

FOREIGN PATENT DOCUMENTS

| | | | | | |
|---|---|---|---|---|---|
| CN | 109610498 | A | * | 4/2019 | ..... E02D 3/00 |
| CN | 211713965 | U | | 10/2020 | |
| CN | 115305877 | A | * | 11/2022 | ..... E02B 8/06 |
| CN | 116122288 | A | * | 5/2023 | ..... E02D 15/02 |
| CN | 116791530 | A | * | 9/2023 | ..... E02B 7/04 |
| CN | 117702792 | A | * | 3/2024 | ..... E02D 15/04 |
| CN | 120520195 | A | * | 8/2025 | ..... E02D 15/02 |
| CN | 120520238 | A | * | 8/2025 | ..... E02B 3/16 |
| JP | 58091212 | A | * | 5/1983 | |

* cited by examiner

TUBULAR STORAGE AND FILLING DEVICE FOR HYDRAULIC MASS CONCRETE AND ITS APPLICATION

CROSS-REFERENCE TO RELATED APPLICATION

This application claims priority to Chinese patent application No. CN202510238595.2, filed to China National Intellectual Property Administration (CNIPA) on Mar. 3, 2025, which is herein incorporated by reference in its entirety.

TECHNICAL FIELD

The disclosure relates to the technical field of hydraulic structures, and more particularly to a tubular storage and filling device for hydraulic mass concrete and its application.

BACKGROUND

During the construction of mass concrete placement in hydraulic structures, preformed holes are sometimes required. At present, the commonly used method involves embedding polyvinyl chloride (PVC) pipes to form these holes. Although this method is simple and easy, there are still the following problems in the process of mass concrete placement. Firstly, in certain construction scenarios, suitable materials need to be filled into the preformed holes simultaneously while forming the holes. The existing PVC pipe method can only form the preformed holes, it cannot achieve concurrent hole formation and material filling, limiting its applicability. Secondly, when concrete is vibrated using immersion vibrators, the PVC pipes are prone to displacement, compromising positional accuracy and resulting in significant deviations. Furthermore, displaced or tilted PVC pipes increase difficulties in subsequent pipe extraction and may lead to issues such as pipe breakage.

Sluice is composed of sluice floor and pier, which is a hydraulic mass concrete structure. Due to the large volume and complex structure of mass concrete, coupled with concrete's low thermal conductivity, the heat of hydration generated by cement becomes trapped and difficult to dissipate within the structure. If this heat management issue is improperly controlled, it can readily induce cracking in the mass concrete. Consequently, the primary cause of cracks in the pier is that the tensile stresses induced by temperature variations during concrete hardening exceed the ultimate tensile strength of the concrete.

In order to solve this problem, some solutions have also appeared in the related art, such as using low-heat or moderate-heat cement in pier construction and arranging cooling water pipes for cooling during concrete placement. However, using low-heat or moderate-heat cement has the problems of high costs and economic inefficiency. The process of introducing cooling water can really play a positive role in controlling the cracks in pier concrete. However, the significant temperature differential between the high-temperature concrete interior and the cooling water pipes creates steep thermal gradients. The concrete temperature near cooling water pipes is highly responsive to changes in cooling water temperature. The substantial temperature differential between the concrete interior and pipe walls induces early-age tensile cracking at the pipe-concrete interface, generating microcracks. Positions where the microcracks are located becomes localized vulnerable zones.

Although no immediate issues arise during initial operation, in the later service period, under the influence of multiple factors such as the internal stress of the pier concrete and the environmental temperature change during operation (especially in the case of cold wave attack), the concrete will be deformed. These microcracks will induce large cracks, which will destroy the structural integrity, stability, durability and watertightness, and affect the normal use. In addition, the cooling water pipes inside the pier cannot be pulled out, and it will be permanently embedded in the pier concrete, resulting in cavities inside the pier, which will affect the integrity of the overall structure, reduce the overall strength of the pier, and affect the durability and safety of the sluice.

It can be seen that there are still some disadvantages whether using low-heat or moderate-heat cement or cooling pipe circulation. Based on this, how to design an effective device and technology, effectively control the cracks of hydraulic mass concrete structure with a new measure, and improve the durability and safety of mass concrete needs further study.

SUMMARY

The disclosure aims at solving one of technical problems in the related art at least to some extent. Therefore, the disclosure provides a tubular storage and filling device for hydraulic mass concrete and its application.

Technical solutions for solving the technical problems of the disclosure are as follows.

In an aspect, the disclosure provides a tubular storage and filling device for hydraulic mass concrete, including a filling body. The filling body at least includes an outer tube body. A bottom sealing plate is connected to a bottom end of the outer tube body, and the bottom sealing plate is defined with at least one discharging port. A storage space is defined inside the outer tube body and configured to store a material.

The tubular storage and filling device for hydraulic mass concrete further includes an inflatable and deflatable airbag, the airbag is located inside the outer tube body above the bottom sealing plate. A gas pipe is disposed in the outer tube body, a bottom end of the gas pipe is connected to the airbag, and a top end of the gas pipe extends above a top end of the outer tube body. A switch is disposed on the gas pipe and is capable of being opened and closed. When the airbag is inflated, the airbag is capable of completely blocking the discharging port, and when the airbag is deflated, the discharging port is capable of opening for discharging the material.

In an embodiment, the filling body further includes an inner tube body which is sleeved within the outer tube body. A bottom of the inner tube body is fixedly connected to the bottom sealing plate. The airbag is sleeved on the inner tube body and connected to an outer wall of the inner tube body. The gas pipe is located within the inner tube body, and the storage space is defined between the inner tube body and the outer tube body.

In an embodiment, an upper bearing plate is further disposed above the airbag, a space for installing the airbag is formed between the upper bearing plate and the bottom sealing plate, and the upper bearing plate is defined with a circulation port adapted to the discharging port.

In an embodiment, a top of the inner tube body extends above a top of the outer tube body, and a connecting rod is connected between the outer tube body and inner tube body.

In an embodiment, the tubular storage and filling device for hydraulic mass concrete further includes a supporting piece. The supporting piece is disposed at a bottom of the outer tube body. The bottom of the outer tube body is defined with a slot along a circumferential direction, and the supporting piece is engageable with the slot.

In an embodiment, the supporting piece is of a linear or cross-shaped structure.

In an embodiment, the tubular storage and filling device for hydraulic mass concrete further includes a connecting piece and a pressing piece. The connecting piece includes a pressure sleeve, and a top of the pressure sleeve is connected to a positioning sleeve. The pressure sleeve is provided with an annular partition plate, and the annular partition plate is fixedly connected to an inner wall of the pressure sleeve. A bottom of the pressure sleeve is defined with a latching notch, and the latching notch is compatible and clamped with the top of the inner tube body. The pressing piece includes a cross brace threadedly connected to a threaded rod, a bottom of the threaded rod is adaptively inserted into the positioning sleeve, and a side wall of the pressure sleeve is defined with an opening configured to allow the gas pipe to pass through.

In another aspect, the disclosure provides an application of a tubular storage and filling device for hydraulic mass concrete, which is applied to sluice crack control, and includes the following steps:

S1: performing construction preparation;

S2: performing foundation treatment;

S3: constructing a sluice floor;

S4: constructing a pier, including:

S41: performing construction layout;

S42: binding and installing pier reinforcement;

S43: erecting a pier formwork above the sluice floor;

S44: detachably installing the tubular storage and filling device for hydraulic mass concrete at a design position;

S45: connecting the gas pipe to an inflation device; opening the switch, activating the inflation device to inflate the airbag until the airbag completely blocks the discharging port, then closing the switch, and disconnecting the inflation device;

S46: casting, vibrating, and curing concrete;

S47: filling the outer tube body with a ductile material; and

S48: after initial setting of the concrete, opening the switch to deflate the airbag and open the discharging port; releasing positional constraints, extracting the tubular storage and filling device for hydraulic mass concrete upward to form a cavity; simultaneously filling the ductile material to the cavity via the discharging port, achieving simultaneous tube extraction and cavity filling.

In an embodiment, the ductile material includes but is not limited to rubberized concrete, acrylic-modified concrete, acrylic-modified rubberized concrete, rubberized mortar, and acrylic-modified rubberized mortar.

In an embodiment, the step S44 of detachably installing the tubular storage and filling device for hydraulic mass concrete includes:

S44-1: installing the supporting piece at the design position and binding the supporting piece to the pier reinforcement to form a lower limit foundation;

S44-2: placing the filling body onto the supporting piece, and making the slot at the bottom of the outer tube body engage with the supporting piece;

S44-3: installing the connecting piece onto the top of the inner tube body; passing the gas pipe through the opening of the pressure sleeve;

S44-4: placing the cross brace above the connecting piece and temporarily binding the cross brace to the pier reinforcement; rotating the threaded rod downward to press into the positioning sleeve at a top of the connecting piece, forming an upper limit foundation through cooperation of the pressing piece and the connecting piece; and fixing the filling body by the upper limit foundation and the lower limit foundation, thereby realizing positioning of the filling body within the pier reinforcement.

Compared with the related art, the disclosure has the following beneficial effects.

1. The tubular storage and filling device for hydraulic mass concrete designed by the disclosure can realize simultaneous hole-forming and filling by arranging structures such as the airbag and the bottom sealing plate, and has small use limitation and is suitable for various occasions. In addition, the process of filling while forming holes can also ensure that the filled materials can be effectively integrated with the surrounding concrete to ensure the overall strength.

2. The tubular storage and filling device for hydraulic mass concrete is also provided with components such as the supporting piece, the connecting piece and the pressing piece, which can realize the positioning and installation of the filling body. When the vibrator vibrates the concrete, the filling body will not be displaced, so as to ensure the position accuracy, avoid the following problems such as difficulty in tube extraction caused by its displacement and inclination during vibrating, and facilitate the construction.

3. The tubular storage and filling device for hydraulic mass concrete has a wide range of applications, and can be applied to mass concrete projects such as sluices, concrete gravity dams, reservoirs and dikes. Taking the sluice as an example, when the sluice is constructed, the tubular storage and filling device is used to reserve a cavity in the pier, and the cavity is filled with the ductile material, the strength of which is basically the same as that of the surrounding concrete, and the ductile material can effectively absorb the stress generated in the pier, ensuring that the maximum stress in the pier is less than the ultimate tensile strength of the pier concrete, thus effectively controlling cracks in the pier. Moreover, the construction technology of filling while forming holes can ensure that the filled ductile material and the surrounding concrete form a complete whole. When the device is applied to sluice construction, it can effectively control the pier cracks, ensure the construction quality and improve the durability and safety of the project.

BRIEF DESCRIPTION OF DRAWINGS

The accompanying drawings are provided to provide a further understanding of the disclosure and constitute a part of the specification, and together with embodiments of the disclosure, serve to explain the disclosure, and do not constitute a limitation of the disclosure.

DESCRIPTION OF REFERENCE SIGNS

Figure 1:
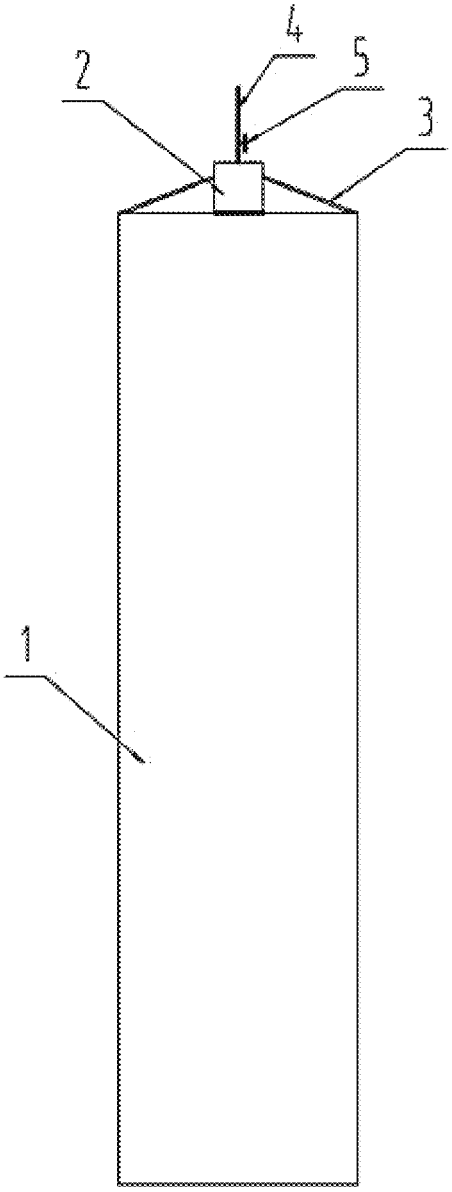
FIG. 1 illustrates a front view of a filling body according to an embodiment of the disclosure.
Figure 2:
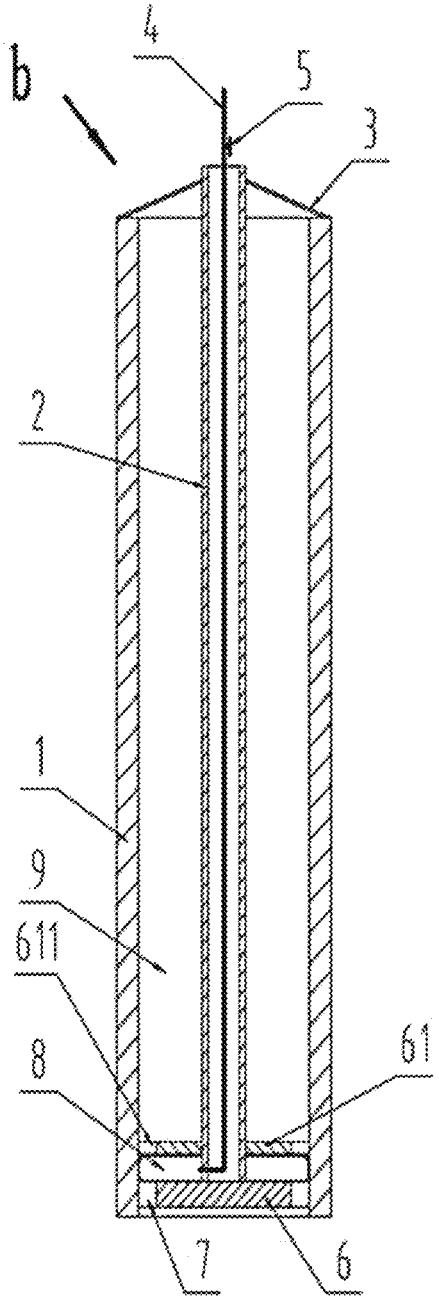
FIG. 2 illustrates a sectional view of the filling body in FIG. 1.
Figure 3:
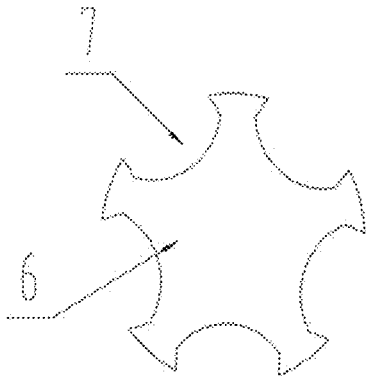
FIG. 3 illustrates a bottom view of a bottom sealing plate in FIG. 2.
Figure 4:
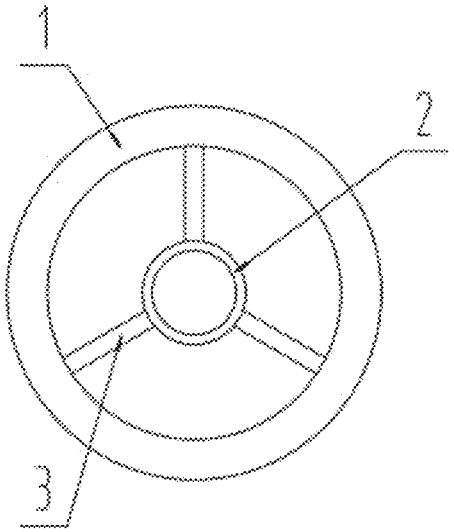
FIG. 4 illustrates a top view of an outer tube body and an inner tube body in FIG. 2.
Figure 5:
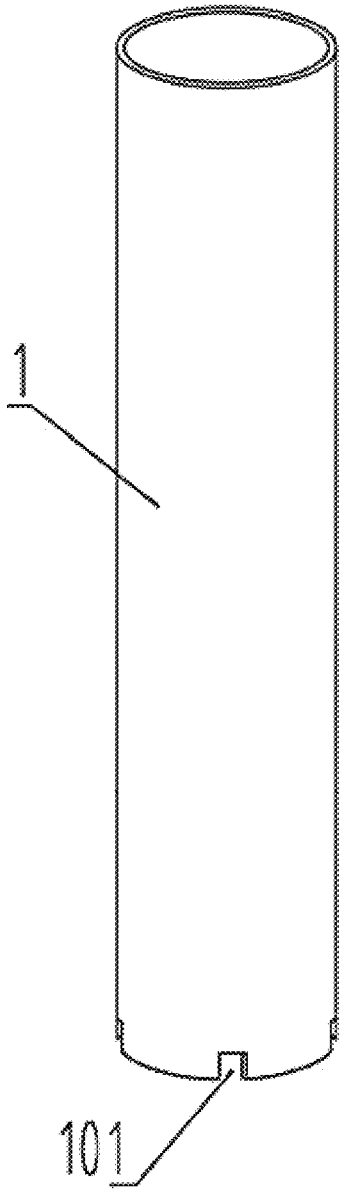
FIG. 5 illustrates a schematic structural view of an outer tube body according to another embodiment of the disclosure.
Figure 6:
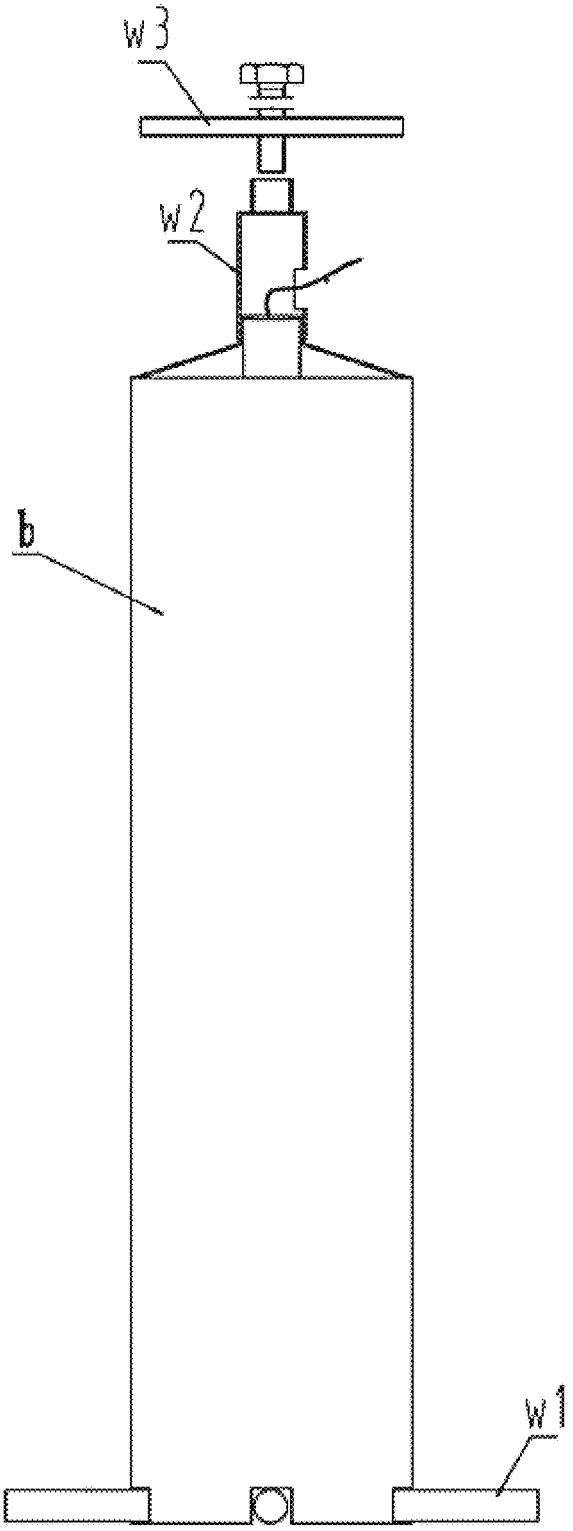
FIG. 6 illustrates a schematic structural view of a tubular storage and filling device for hydraulic mass concrete during coordinated operation.
Figure 7:
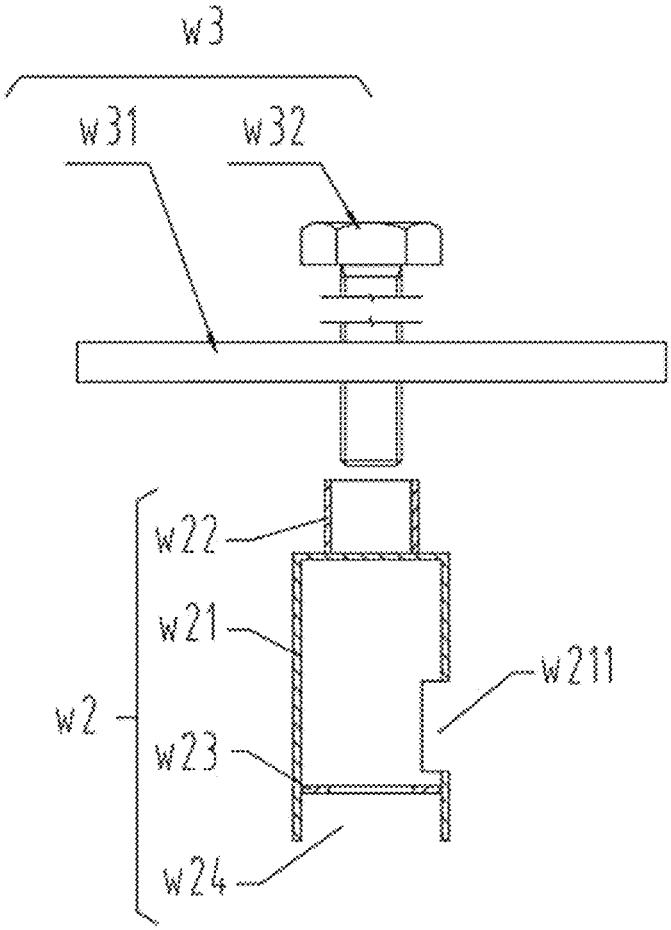
FIG. 7 illustrates an enlarged view of a pressing piece and a connecting piece in FIG. 6.
Figure 8:
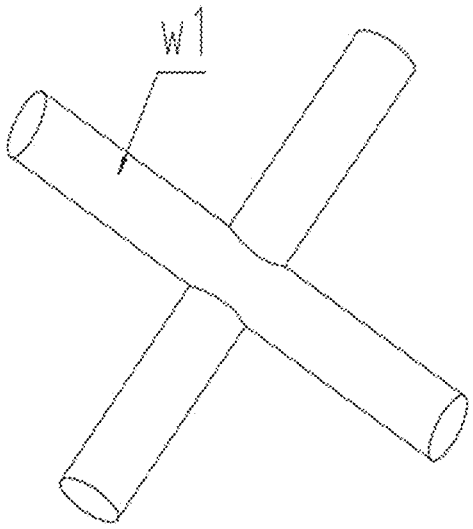
FIG. 8 illustrates a perspective view of a supporting piece in FIG. 6.
Figure 9:
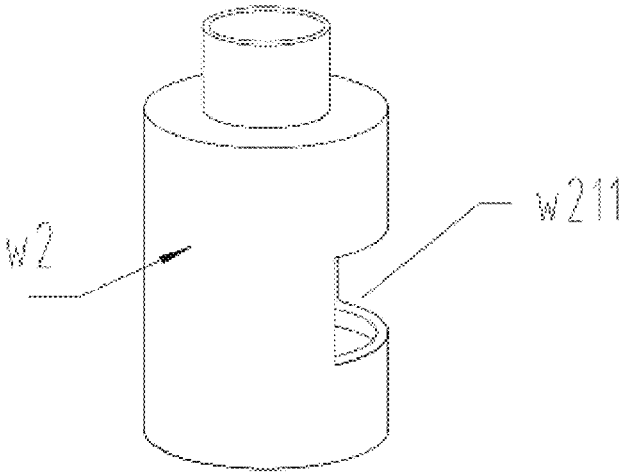
FIG. 9 illustrates a perspective view of the connecting piece in FIG. 6.
Figure 10:
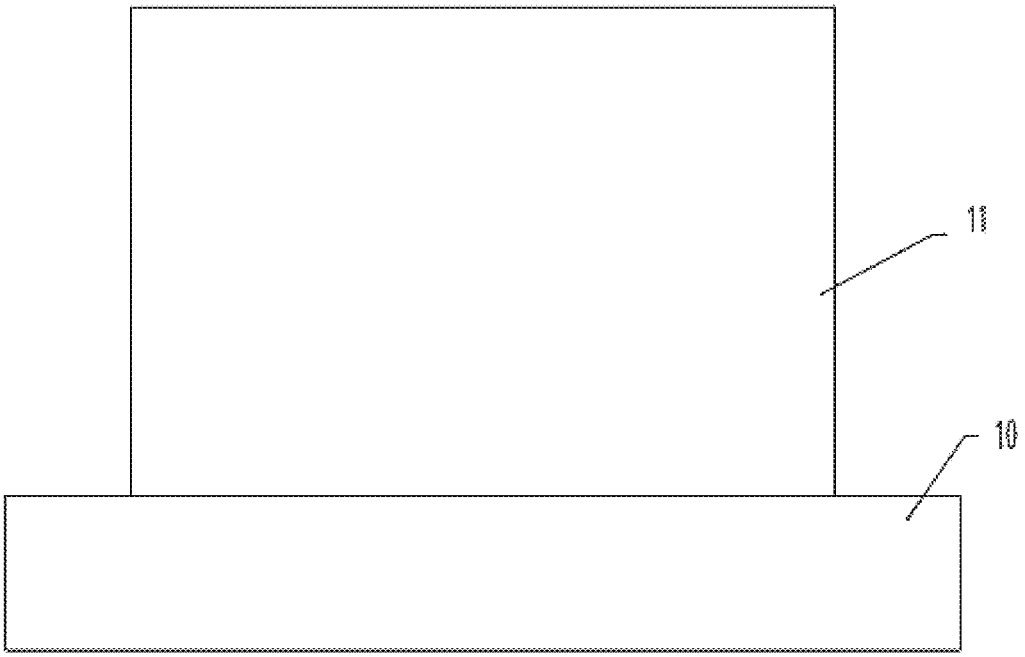
FIG. 10 illustrates a structural side view of a sluice.

1. outer tube body; 101. slot; 2. inner tube body; 3. connecting rod; 4. gas pipe; 5. switch; 6. bottom sealing plate; 61. upper bearing plate; 611. circulation port; 7. discharging port; 8. airbag; 9. storage space; 10. sluice floor; 11. pier; 12. cavity; 13. ductile material; 14. skeleton reinforcement; 15. pier reinforcement; 16. stress absorption layer; 17. pier formwork; w1. supporting piece; w2. connecting piece; w21. pressure sleeve; w211. opening; w22. positioning sleeve; w23. annular partition plate; w24. latching notch; w3. pressing piece; w31. cross brace; w32. threaded rod; b. filling body; and 18. inflation device.

DETAILED DESCRIPTION OF EMBODIMENTS

Hereinafter, embodiments of the disclosure will be described in detail, examples of the embodiments are illustrated in the accompanying drawings, and same or similar reference signs indicate same or similar elements or elements having the same or similar functions throughout. The embodiments described below by referring to the attached drawings are exemplary and are intended to explain the disclosure, but not to be construed as limiting the disclosure.

In the description of the disclosure, the terms "first", "second" and the like are only used for descriptive purposes and cannot be understood as indicating or implying relative importance. In addition, in the description of the disclosure, unless otherwise specified, "multiple" means two or more.

In the description of this specification, descriptions referring to the terms "one embodiment", "some embodiments", "examples", "specific examples" or "some examples" mean that specific features, structures, materials or characteristics described in connection with this embodiment or example are included in at least one embodiment or example of this disclosure. In this specification, the schematic expressions of the above terms do not necessarily refer to the same embodiment or example. Moreover, the specific features, structures, materials or characteristics described may be combined in any one or more embodiments or examples in a suitable manner.

Embodiment 1

As shown in FIG. 1 to FIG. 9, this embodiment proposes a tubular storage and filling device for hydraulic mass concrete, which includes a filling body b. The filling body b at least includes an outer tube body 1, and a bottom end of the outer tube body 1 is connected to a bottom sealing plate 6, and the bottom sealing plate 6 and the outer tube body 1 are fixedly connected or screwed. The bottom sealing plate 6 is provided with at least one discharging port 7. In this embodiment, multiple discharging ports 7 are provided along a circumferential direction of the bottom sealing plate 6. A storage space 9 for storing materials is arranged inside the outer tube body 1.

The filling body b further includes an inflatable and deflatable airbag 8. The airbag 8 is located inside the outer tube body 1 and above the bottom sealing plate 6. The bottom sealing plate 6 is used to support the airbag 8 and the materials inside. A gas pipe 4 is arranged in the outer tube body 1, a bottom end of the gas pipe 4 is connected to the airbag 8, and a top end of the gas pipe 4 extends above a top end of the outer tube body 1. After the gas pipe 4 is connected to an inflation device, the airbag 8 can be inflated. The gas pipe 4 is provided with a switch 5, which is convenient to control on or off. When the airbag 8 is inflated, the airbag 8 bulges, and the airbag 8 can completely block the discharging port 7, thereby preventing internal materials from falling. When the airbag 8 is deflated, the airbag 8 deflates, and the discharging port 7 is opened for discharging the materials.

In some embodiments, the filling body b further includes an inner tube body 2, which is sleeved within the outer tube body 1, and a bottom of the inner tube body 2 is fixedly connected to the bottom sealing plate 6 by welding. The airbag 8 is sleeved on the inner tube body 2 and connected to an outer wall of the inner tube body 2. The gas pipe 4 is located in the inner tube body 2, and the bottom end of the gas pipe 4 penetrates through the inner tube body 2 and is connected to the airbag 8. A region between the inner tube body 2 and the outer tube body 1 forms the storage space 9, which is an annular region.

In some embodiments, considering that it is easier to operate the airbag 8, an upper bearing plate 61 is further arranged above the airbag 8, the upper bearing plate 61 is fixedly connected to the inner tube body 2, a space for installing the airbag 8 is formed between the upper bearing plate 61 and the bottom sealing plate 6, and the airbag 8 is arranged in the space. The upper bearing plate 61 is provided with a circulation port 611 adapted to the discharging port 7 to facilitate the circulation of materials.

In this embodiment, the top of the inner tube body 2 extends above the top of the outer tube body 1, and a connecting rod 3 is connected between the outer tube body 1 and the inner tube body 2, which plays a reinforcing role and can also be used as a lifting point. In this embodiment, the airbag 8 can be made of rubber dam bag material, which is wear-resistant and not easy to be damaged.

Embodiment 2

As shown in FIG. 1 to FIG. 9, on the basis of the embodiment 1, the tubular storage and filling device for hydraulic mass concrete further includes a supporting piece w1, which is arranged at the bottom of the outer tube body 1 for supporting and positioning. The bottom of the outer tube body 1 is provided with a slot 101 along the circumferential direction. The supporting piece w1 can be clamped with the slot 101. The slot 101 is a linear or cross-shaped groove, and correspondingly, the supporting piece w1 is of a linear or cross-shaped structure. In this embodiment, the supporting piece w1 is of the cross-shaped structure.

The tubular storage and filling device for hydraulic mass concrete further includes a connecting piece w2 and a pressing piece w3. The connecting piece w2 includes a pressing sleeve w21, the top of the pressing sleeve w21 is connected to a positioning sleeve w22, and the pressing sleeve w21 and the positioning sleeve w22 form a stepped shaft structure. An annular partition plate w23 is arranged in the pressing sleeve w21, and the annular partition plate w23 is fixedly connected to the inner wall of the pressing sleeve w21. The annular partition plate w23 is arranged near the bottom of the pressure sleeve w21. A latching notch w24 is formed at the bottom of the pressing sleeve w21, and the latching notch w24 is matched and clamped with the top of the inner tube body 2. The pressing piece w3 includes a cross brace w31, and the cross brace w31 is threadedly connected to a threaded rod w32, and the bottom of the threaded rod w32 is matched and inserted with the positioning sleeve w22. A side wall of the pressing sleeve w21 is provided with an opening w211 through which the gas pipe 4 passes.

Technical effects are as follows. The tubular storage and filling device for hydraulic mass concrete is provided with components such as the supporting piece w1, the connecting piece w2 and the pressing piece w3, so that the positioning and installation of the filling body b can be realized. When a vibrator rod vibrates the concrete, the filling body b will not be displaced, so that the position accuracy is ensured, and problems such as subsequent difficulty in tube extraction caused by the displacement and inclination of the vibrator are avoided, which is convenient for construction.

Embodiment 3

In this embodiment, an application of the tubular storage and filling device for hydraulic mass concrete is proposed, which can be used in concrete construction of gravity dams, reservoirs, dikes, equipment foundations, etc. This method adopts the tubular storage and filling device for hydraulic mass concrete in the embodiment 1 or the embodiment 2 and is applied to the construction of concrete preformed holes, including the following steps.

a1. The tubular storage and filling device for hydraulic mass concrete is installed at a designated position. It should be noted that during installation, it is necessary to ensure that the filling body b can be disassembled later.

a2. The gas pipe 4 is connected to an inflation device 18. The switch 5 is turned on, start the inflation device 18 to inflate the airbag 8, and the airbag 8 will bulge until the airbag 8 completely blocks the discharging port 7. Then, the switch 5 is turned off and the inflation device 18 is disassembled.

a3. The concrete is poured to a design position, vibrated and cured.

a4. Materials are filled into the outer tube body 1. The materials are selected according to actual projects, such as acrylic-modified mortar, rubberized concrete, etc.

a5. After the initial setting of concrete, the switch 5 is turned on, the airbag 8 is deflated, and the discharging port 7 is opened. The tubular storage and filling device for hydraulic mass concrete is lifted out, and a cavity 12 is formed after being lifted out. At the same time of lifting, the material enters the cavity 12 through the discharging port 7 to fill the cavity 12, so as to realize the filling while tube extraction.

Application effects are as follows.

The tubular storage and filling device for hydraulic mass concrete designed by the disclosure is suitable for the manufacturing process of concrete preformed holes. By arranging the structures such as the airbag 8, the bottom sealing plate 6, etc., the holes can be formed and filled simultaneously, so that the use limitation is small, and the tubular storage and filling device is suitable for various occasions. In addition, the process of filling while forming holes can also ensure that the filled materials can be effectively integrated to the surrounding concrete to ensure the overall strength.

Embodiment 4

Referring to FIG. 1 to FIG. 21, this embodiment proposes an application of a tubular storage and filling device for hydraulic mass concrete. The tubular storage and filling device for hydraulic mass concrete is applied to crack control of sluice, including the following steps.

S1: Construction preparation. A construction plan is prepared, construction materials and equipment are determined, and personnel training is carried out, etc.

S2: Foundation treatment. Before the construction of the sluice floor 10 and pier 11, the foundation needs to be treated to ensure the bearing capacity and stability of the foundation.

S3: Construction of the sluice floor 10: binding and installation of skeleton reinforcement 14, erecting the formwork of the sluice floor 10, concrete placement, and forming the sluice floor 10. Specifically, S31. binding of skeleton reinforcement 14: the skeleton reinforcement 14 is bound and installed in accordance with the design drawings to ensure that the spacing of the reinforcement and the anchorage length meet the required specifications. S32. erecting the formwork of the sluice floor 10: a suitable formwork is selected and installed according to the design drawings. The formwork support system is set up to ensure the stability of the formwork. S33. concrete placement: concrete is poured using a layered pouring method, and compaction is ensured through proper vibration during the pouring process. S34. concrete curing: after the concrete placement is completed, the concrete is cured in time to ensure the strength of the concrete, and finally, the formwork is removed to obtain the formed sluice floor 10.

S4: Construction of pier 11: the specific construction steps are as follows.

S41: Construction layout.

S42: Binding and installation of pier reinforcement 15.

S43: A pier formwork 17 is erected above the sluice floor 10.

S44: The tubular storage and filling device for hydraulic mass concrete is detachably installed at the design position. The tubular storage and filling device for hydraulic mass concrete is temporarily fixed, and the tube can be pulled out later.

S45: The gas pipe 4 is connected to the inflation device 18; the switch 5 is turned on to start the inflation device 18 to inflate the airbag 8, and the airbag 8 will bulge until the airbag 8 completely blocks the discharging port 7, then the switch 5 is turned off and the inflation device 18 is disassembled.

S46: The concrete is poured to a design position, vibrated and cured.

S47: The ductile material 13 is filled into the outer tube body 1.

S48: After the initial setting of concrete, the switch 5 is turned on, the airbag 8 is deflated, and the discharging port 7 is opened. The limit is released, the tubular storage and filling device for hydraulic mass concrete is lifted out, and a cavity 12 is formed after being lifted out. At the same time of lifting, the ductile material 13 enters the cavity 12 through the discharging port 7 to fill the cavity 12, so as to realize the filling while tube extraction.

In this embodiment, the ductile material 13 includes but is not limited to rubberized concrete, acrylic-modified concrete, acrylic-modified rubberized concrete, rubberized mortar, and acrylic-modified rubberized mortar. The ductile material 13 has good mechanical and deformation properties. The ductile material 13 can effectively absorb the temperature deformation energy generated by concrete hydration of the pier 11, release the temperature stress, reduce the stress constraint, and effectively control the cracks of the pier 11. The strength of the ductile material 13 is basically the same as that of the surrounding concrete, and the ductile material 13 can effectively absorb the stress generated inside the pier 11, ensuring that the maximum stress in the pier 11 is less than the ultimate tensile strength of the concrete of the pier 11, thus effectively controlling the cracks in pier 11, ensuring the construction quality and improving the durability and safety of the project.

In addition, the ductile material 13 cooperates with the reinforcement inside the pier 11 to form a dual control system of "prevention in advance and passive defense". First, it can control the occurrence of cracks, and secondly, even if microcracks occur, it can better control the development of microcracks inside the pier 11 towards large cracks, which is beneficial to the long-term operation of the pier 11 and improves durability and safety.

In the above scheme, the specific installation method of the tubular storage and filling device for hydraulic mass concrete in the S44 is as follows.

S44-1. Installation of the supporting piece w1. The supporting piece w1 is placed at the design position, and the supporting piece w1 is bound and connected to the pier reinforcement 15 to construct a lower limit foundation.

S44-2. Installation of the filling body b. The filling body b is placed and pressed on the supporting piece w1, and the slot 101 at the bottom of the outer tube body 1 is clamped with the supporting piece w1.

S44-3. Installation of the connecting piece w2. The connector w2 is sleeved and installed on the top of the inner tube body 2. The gas pipe 4 passes through the opening w211 of the pressure sleeve w21.

S44-4. Installation of the pressing piece w3. The cross brace w31 is placed above the connecting piece w2, and temporarily bound and fixed with the pier reinforcement 15. The threaded rod w32 is rotated downward to press into the positioning sleeve w22 at the top of the connecting piece w2. The pressing piece w3 cooperates with the connecting piece w2 to form an upper limit foundation, and the upper limit foundation and the lower limit foundation fix the filling body b to realize the positioning of the filling body b in the pier reinforcement 15.

It should be noted that in the S48, the specific method for releasing the limit is as follows: the binding between the cross brace w31 and the pier reinforcement 15 is released, after the pressing piece w3 is removed, the filling body b is lifted out, and the supporting piece w1 is permanently left in the concrete of the pier.

Application effects are as follows.

The tubular storage and filling device for hydraulic mass concrete has a wide range of applications, not only for sluice construction, but also for mass concrete projects such as concrete gravity dams, reservoirs and dikes. Taking the sluice as an example, when the sluice is constructed, the tubular storage and filling device for hydraulic mass concrete is used to reserve a cavity 12 inside the pier 11, and the cavity 12 is filled with the ductile material 13. The strength of the ductile material 13 is basically the same as that of the surrounding concrete, and the ductile material 13 can effectively absorb the stress generated inside the pier 11, so as to ensure that the maximum stress in the pier 11 is less than the ultimate tensile strength of the concrete of the pier 11, thereby effectively controlling the occurrence of cracks in the pier 11. Moreover, the construction technology of filling while forming holes can ensure that the filled ductile material 13 can form a complete whole with the surrounding concrete. When this device is applied to sluice construction, it can effectively control the cracks of the pier 11, ensure the construction quality and improve the durability and safety of the project.

This method is applied to the control of sluice cracks. Compared with the process of controlling sluice cracks by introducing cooling water, the construction is simple, and the process of introducing cooling water can ensure the structural integrity. The cooling water pipe is embedded in the concrete of the pier 11, and the internal structure of the cooling water pipe is hollow, which makes the internal structure of the pier 11 incomplete. However, after filling the ductile material 13, there is no cavity in the pier 11, which makes the structure complete and ensures the overall strength. Compared with the method of adopting low-heat or moderate-heat cement, the disclosure has the advantages of low construction cost and cost saving. This structural design can not only absorb the internal restraint stress of the pier 11, but also reduce the restraint stress of the sluice floor 10 on the pier 11.

According to the above-mentioned construction method, the sluice structure with ductile material 13 can be obtained. The structural forms of the cavity 12 are as follows.

Figure 11:
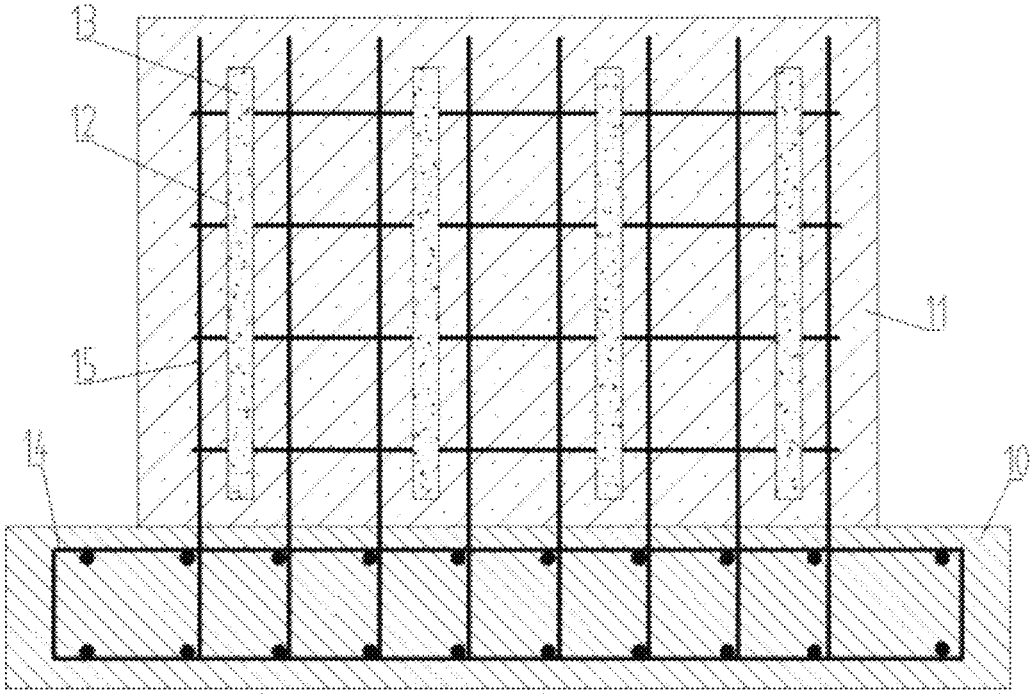
FIG. 11 illustrates a first structural sectional view of the sluice in FIG. 10.

In the first type, the cavity 12 is of a fully enclosed structure, with both ends of the cavity 12 being closed and entirely embedded within the pier 11, as shown in FIG. 11.

Figure 12:
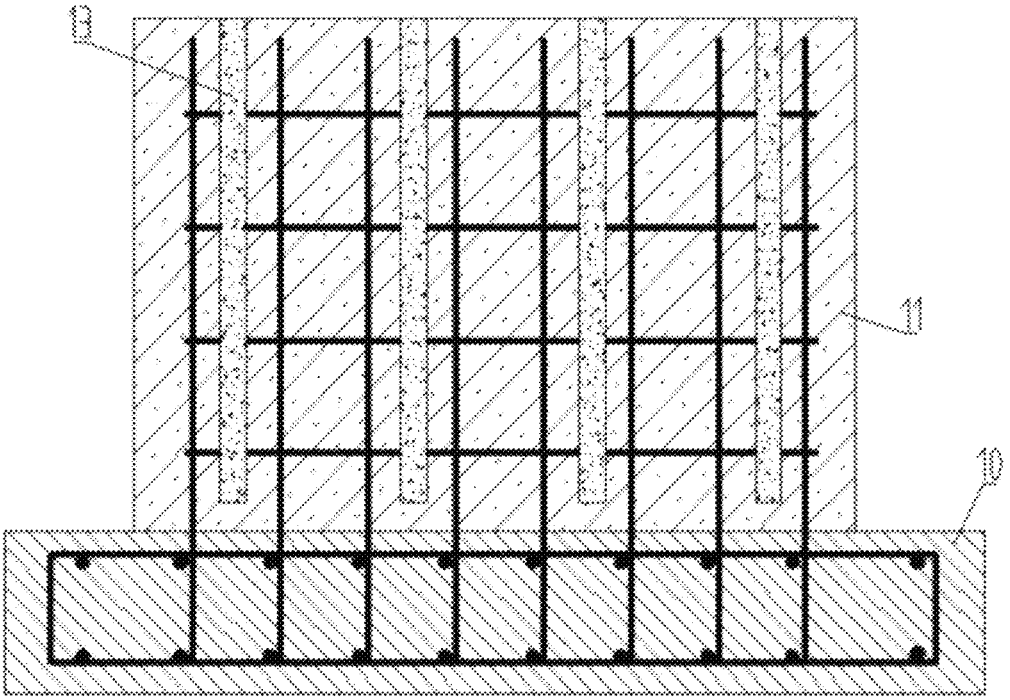
FIG. 12 illustrates a second structural sectional view of the sluice in FIG. 10.

In the second type, the cavity 12 is of a semi-enclosed structure. A bottom end of the cavity 12 is embedded in the pier 11 and is closed, while a top end extends to the upper surface of the pier 11, connecting with the outside and forming an open end, as shown in FIG. 12.

Figure 13:
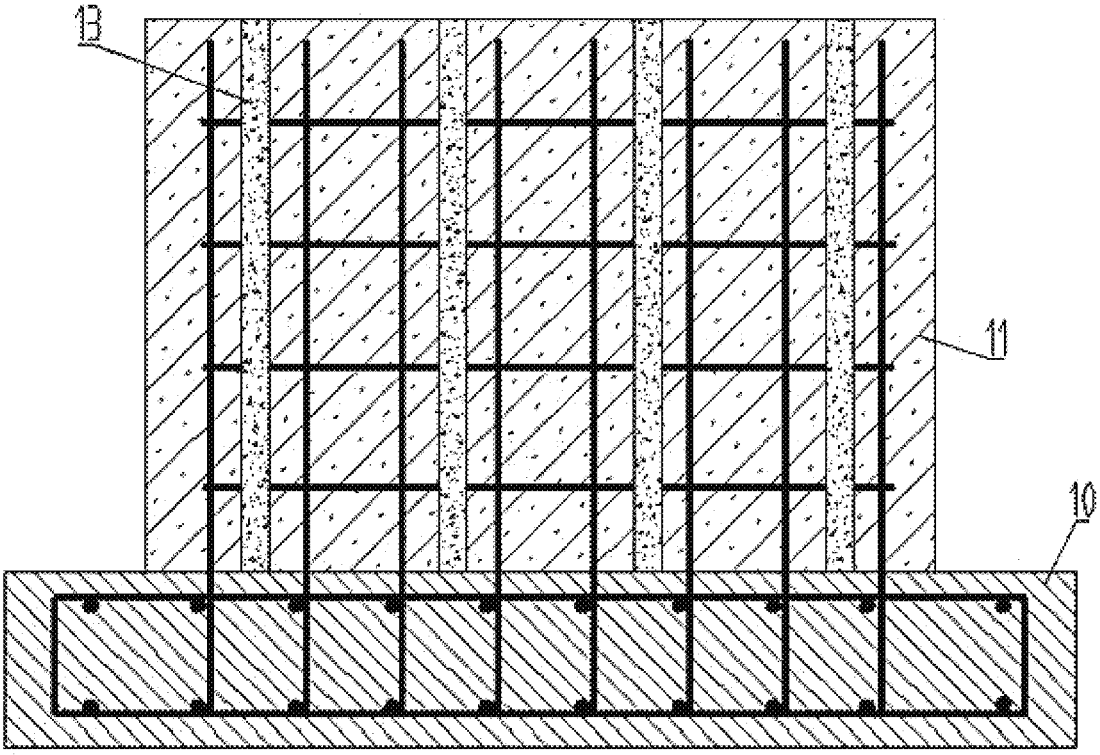
FIG. 13 illustrates a third structural sectional view of the sluice in FIG. 10.

In the third type, the cavity 12 is of an open structure, extending vertically through the pier 11 from the bottom to the top. Both ends of the cavity 12 are flush with the bottom and top surfaces of the pier 11, respectively, as shown in FIG. 13.

Figure 14:
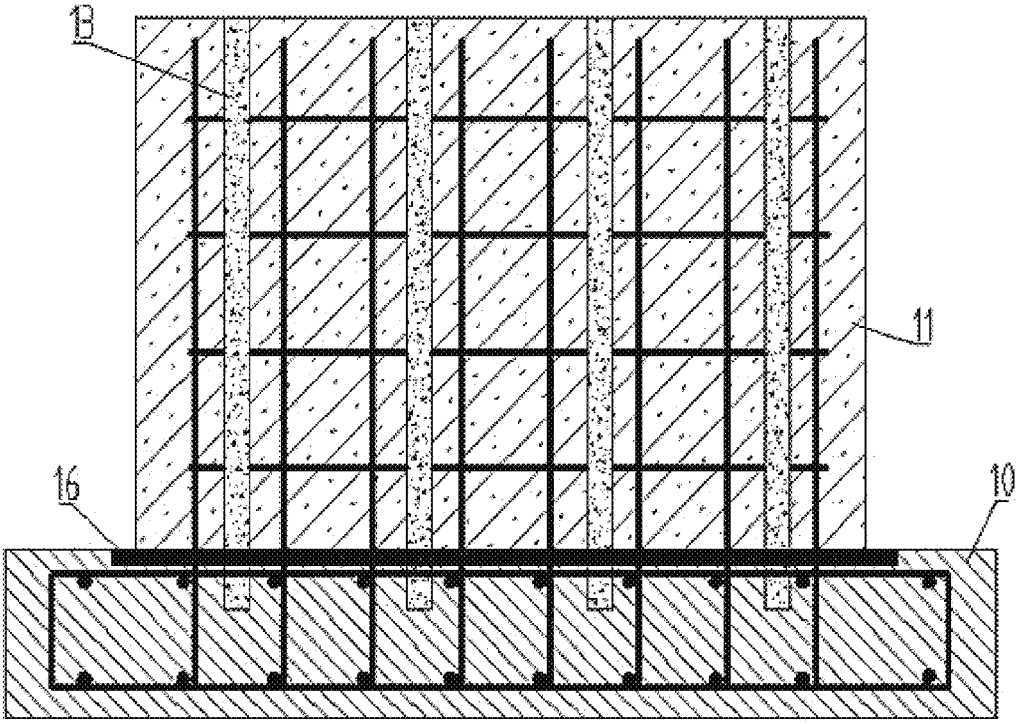
FIG. 14 illustrates a fourth structural sectional view of the sluice in FIG. 10.

In the fourth type, on the basis of any of the above three structural forms, the bottom end of the cavity 12 can also extend through the pier 11 into the sluice floor 10, as shown in FIG. 14. In this embodiment, a stress absorption layer 16 is provided at the joint between the sluice floor 10 and the pier 11, and the bottom end of the cavity 12 penetrates through the stress absorption layer 16. Of course, as another feasible embodiment, the stress absorption layer 16 may not be provided between the pier 11 and the sluice floor 10, and the stress absorption layer 16 may be one of acrylic-modified mortar, rubberized aggregate mortar, or a mixture of rubberized aggregate and acrylic-modified mortar. For reference, please see the applicant's previously patent: METHOD AND FILLING DEVICE FOR CONTROLLING SLUICE PIER CRACKS, with issue No. CN103882836B.

Figure 15:
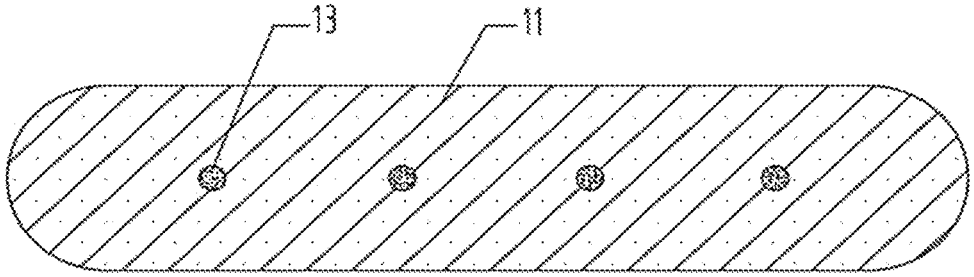
FIG. 15 illustrates a first structural sectional view of a pier in a top view direction.
Figure 16:
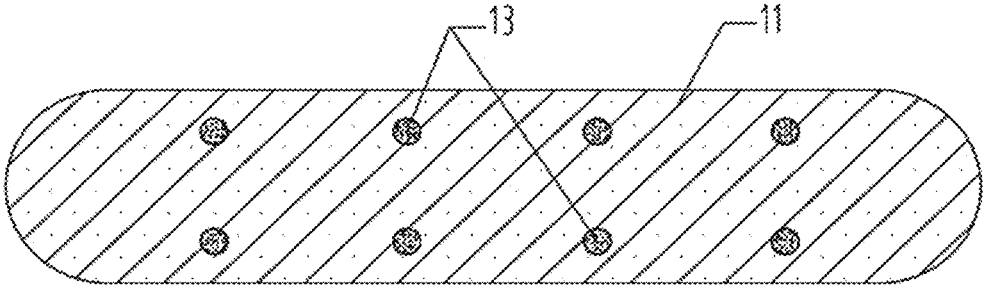
FIG. 16 illustrates a second structural sectional view of the pier in the top view direction.
Figure 17:
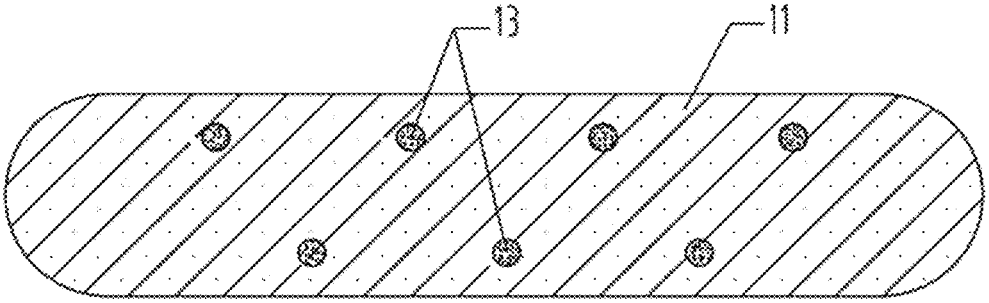
FIG. 17 illustrates a third structural sectional view of the pier in the top view direction.
Figure 18:
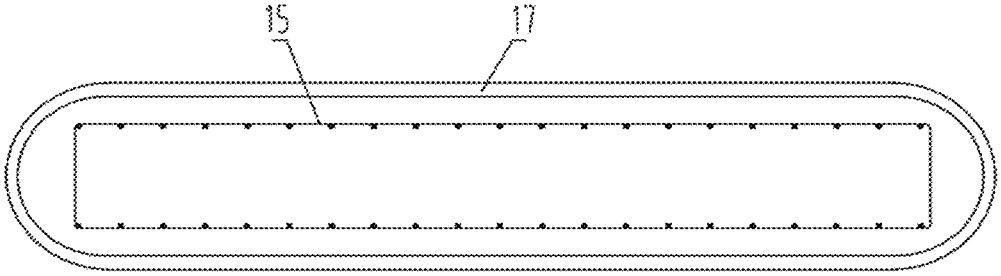
FIG. 18 illustrates a top view of pier reinforcement and pier formwork.
Figure 19:
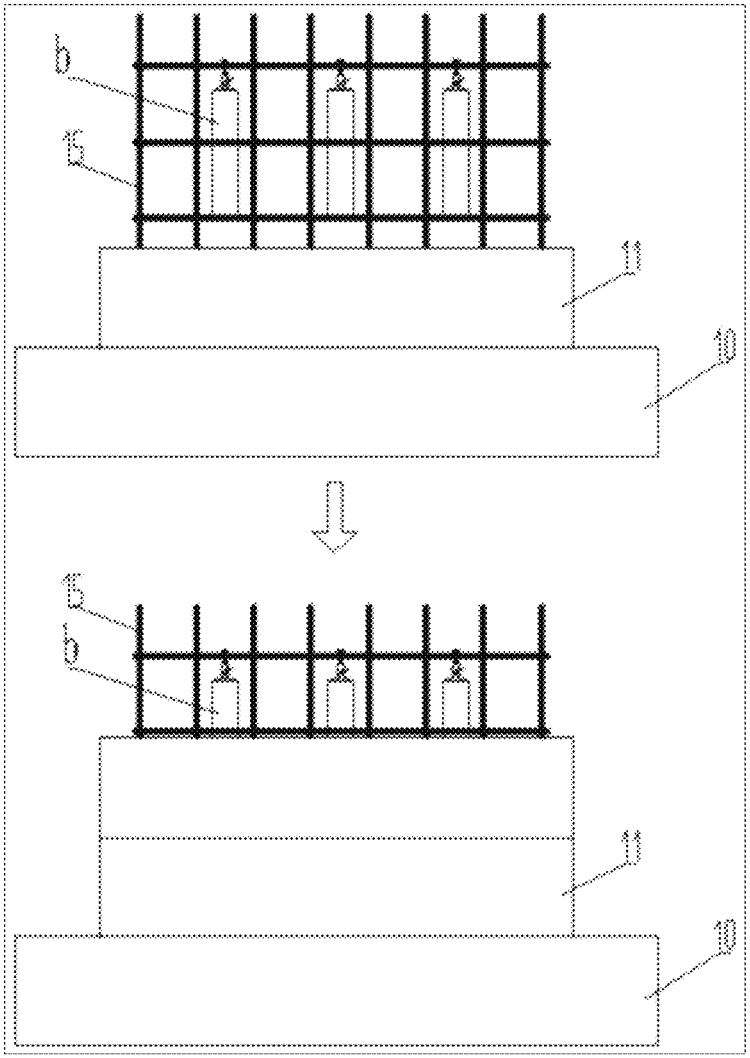
FIG. 19 illustrates a state change diagram of the tubular storage and filling device for hydraulic mass concrete during layered placement of pier concrete.
Figure 20:
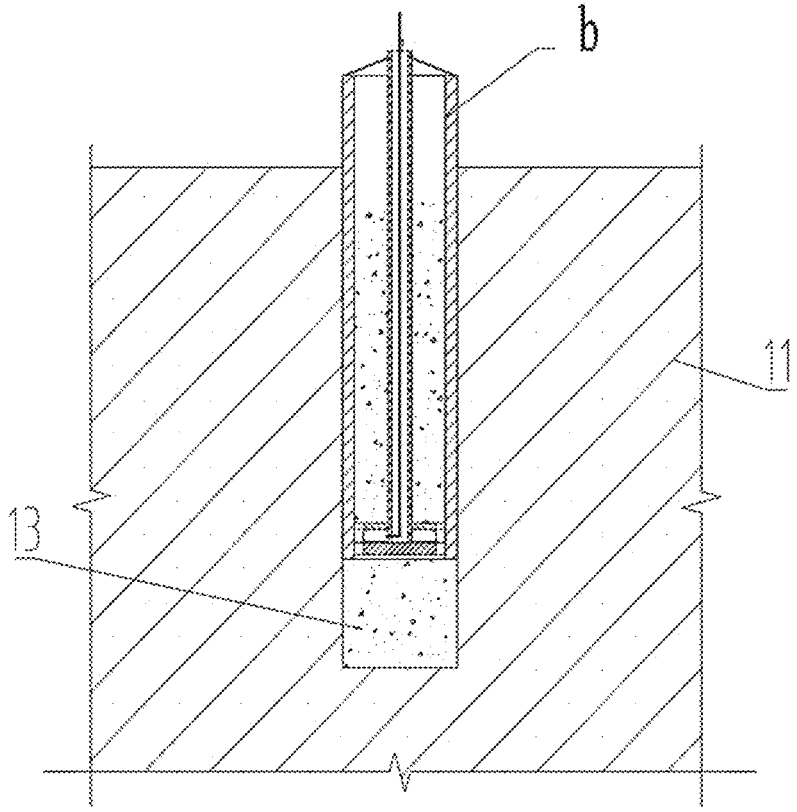
FIG. 20 illustrates a construction state diagram for simultaneous backfilling of ductile materials during extraction of tubes of the tubular storage and filling device for hydraulic mass concrete.
Figure 21:
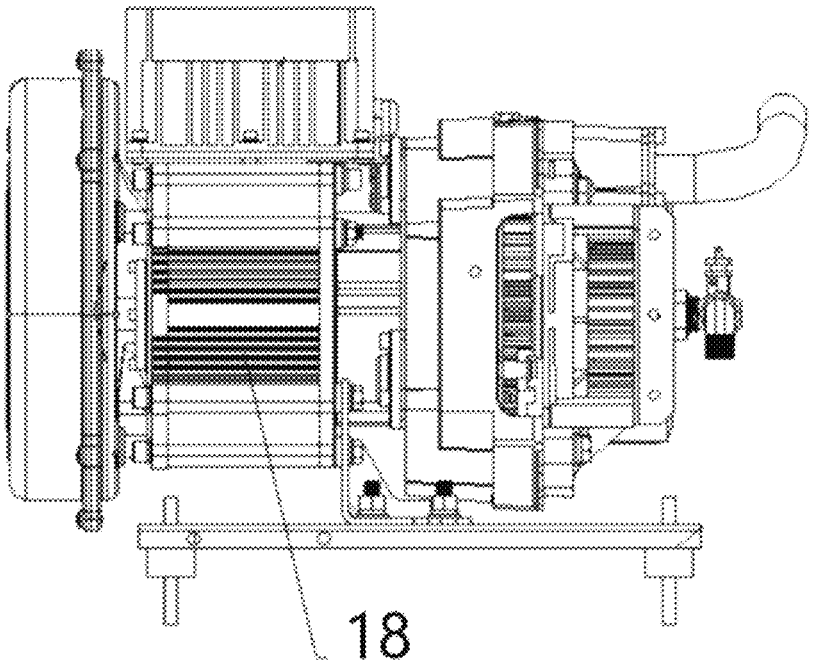
FIG. 21 illustrates a schematic structural view of an inflation device of the disclosure.

In this embodiment, the cavity 12 may be provided in a quantity of one or more, and may be arranged in one row or multiple rows. Referring to FIG. 15 to FIG. 17. If multiple rows are arranged, for example, two rows, the adjacent two rows of cavities 12 are arranged in a staggered manner.

Test Data

Example 1

A certain reservoir spillway sluice is 28 meters long and has three holes. Two rows of cavities 12, with a diameter of 8 centimeters (cm), are arranged within the pier 11. The bottoms of the cavities 12 extend 0.7 meters into the sluice floor 10. The maximum stress measured inside the pier 11 is 0.72 megapascals (MPa), which is less than the ultimate tensile strength of the concrete in the pier 11, i.e., 1.20 MPa.

Example 2

A certain reservoir spillway sluice is 21 meters long and has two holes. One row of cavities 12, with a diameter of 10 cm, is arranged within the pier 11. The cavities 12 extend 0.5 meters into the sluice floor 10. The maximum stress measured inside the pier 11 is 0.86 MPa, which is less than the ultimate tensile strength of the concrete in the pier 11, i.e., 1.16 MPa.

Example 3

A certain reservoir spillway sluice is 36 meters long and has four holes. Two rows of cavities 12, with a diameter of 6 cm, are arranged within the pier 11. A stress absorption layer 16, with a thickness of 20 cm, is provided between the sluice floor 10 and the pier 11. The cavities 12 extend to the sluice floor 10. The maximum stress measured inside the pier 11 is 0.67 MPa, which is less than the ultimate tensile strength of the concrete in the pier 11, i.e., 1.10 MPa.

Example 4

A certain reservoir spillway sluice is 42 meters long and has four holes. Three rows of cavities 12, with a diameter of 8 cm, are arranged within the pier 11. A stress absorption layer 16, with a thickness of 30 cm, is provided between the sluice floor 10 and the pier 11. The bottom ends of the cavities 12 extend 0.8 meters into the sluice floor 10. The maximum stress measured inside the pier 11 is 0.74 MPa, which is less than the ultimate tensile strength of the concrete in the pier 11, i.e., 1.15 MPa.

It can be seen from the above test data that this method can effectively absorb the stress in the pier 11 and ensure that the maximum stress in the pier 11 is less than the ultimate tensile strength of the concrete in the pier 11, thus effectively controlling the cracks in the pier 11, ensuring the construction quality and improving the durability and safety of the project.

Embodiment 5

As a feasible embodiment, if necessary, cooling water can be added to the above construction process to reduce the temperature inside the concrete. There are two ways to arrange cooling water pipes, namely a triangular pattern (also referred to as plum blossom shape) and a rectangular grid pattern (also referred to as well shape). In terms of cooling effect, the triangular pattern demonstrates superior cooling efficiency by eliminating cooling blind zones inherent in the rectangular grid pattern, but the working hours are not well controlled. Consequently, the rectangular grid pattern remains the prevailing choice in engineering practice. In terms of materials, cooling water pipes mainly include metal pipes and plastic pipes. Metal pipe has strong thermal conductivity and good cooling effect, and is hardly affected by the thickness of water pipe, but the construction is more complicated. The thermal performance of plastic pipe is poor, and the cooling effect is greatly influenced by the wall thickness of water pipe. The thicker the wall of plastic water pipe, the worse the cooling effect, but the construction is relatively simple, and it has been used more and more in engineering in recent years. Therefore, whether and how to arrange the cooling water pipes are determined according to the actual engineering situation.

In the disclosure, unless otherwise specified and limited, the terms "installation", "connected", "connection" and "fixation" should be broadly understood, for example, they may be fixedly connected, detachably connected, or integrally formed; may be mechanically connected, electrically connected, or in communication with each other; or may be directly connected or indirectly connected through an intermediate medium. It may be the internal communication of two elements or the interaction relationship of two elements, unless otherwise expressly defined. Those skilled in the art can understand the specific meaning of the above terms in the disclosure according to the specific situation.

In the disclosure, unless otherwise specified and limited, a first feature "above" or "below" a second feature means that the first and second features are in direct contact, or that the first and second features are in indirect contact through an intermediary. Moreover, the phrases "above", "over", or "on top of the second feature" may mean that the first feature is located vertically above or inclined above the second feature, or simply indicates that the first feature is at a higher horizontal level than the second feature. Similarly, the phrase "below", "under", or "beneath the second feature" may mean that the first feature is located vertically below or inclined below the second feature, or simply indicates that the first feature is at a lower horizontal level than the second feature.

In the disclosure, the terms "one embodiment", "some embodiments", "examples", "specific examples" or "some examples" etc. mean that the specific features, structures, materials or characteristics described in connection with this embodiment or example are included in at least one embodiment or example of the disclosure. In this specification, the schematic expressions of the above terms are not necessarily aimed at the same embodiment or example. Moreover, the specific features, structures, materials or characteristics described may be combined in any one or more embodiments or examples in a suitable manner. In addition, those skilled in the art can combine and associate different embodiments or examples and features of different embodiments or examples described in this specification without contradicting each other.

What is claimed is:

1. A use of a tubular storage and filling device for hydraulic mass concrete, applied in sluice crack control, comprising the following steps:

S1: performing construction preparation;

S2: performing foundation treatment;

S3: constructing a sluice floor (10); and

S4: constructing a pier (11), comprising:

S41: performing construction layout;

S42: binding and installing pier reinforcement (15);

S43: erecting a pier formwork (17) above the sluice floor (10);

S44: detachably installing the tubular storage and filling device for hydraulic mass concrete at a design position;

wherein the tubular storage and filling device for hydraulic mass concrete comprises a filling body (b), and the filling body (b) comprises:

an outer tube body (1);

a bottom sealing plate (6), connected to a bottom end of the outer tube body (1), the bottom sealing plate defining at least one discharging port (7);

a storage space (9), defined inside the outer tube body (1) and configured to store a material;

an airbag (8), being inflatable and deflatable and located inside the outer tube body (1) above the bottom sealing plate (6);

a gas pipe (4), disposed in the outer tube body (1), wherein a bottom end of the gas pipe (4) is connected to the airbag (8), and a top end of the gas pipe (4) extends above a top end of the outer tube body (1);

a switch (5), disposed on the gas pipe (4) and be capable of being opened and closed; wherein when the airbag (8) is inflated, the airbag (8) is capable of completely blocking the discharging port (7), and when the airbag (8) is deflated, the discharging port (7) is capable of opening for discharging the material;

an inner tube body (2), sleeved within the outer tube body (1), wherein a bottom of the inner tube body (2) is fixedly connected to the bottom sealing plate (6); the airbag (8) is sleeved on the inner tube body (2) and connected to an outer wall of the inner tube body (2); the gas pipe (4) is located within the inner tube body (2); and the storage space (9) is defined between the inner tube body (2) and the outer tube body (1); and a supporting piece (w1), disposed at a bottom of the outer tube body (1); wherein the bottom of the outer tube body (1) is defined with a slot (101) along a circumferential direction; and the supporting piece (w1) is engageable with the slot (101);

S45: connecting the gas pipe (4) to an inflation device (18); opening the switch (5), activating the inflation device (18) to inflate the airbag (8) until the airbag (8) completely blocks the discharging port (7), then closing the switch (5), and disconnecting the inflation device (18);

S46: casting, vibrating, and curing concrete;

S47: filling the outer tube body (1) with a ductile material (13); and

S48: after initial setting of the concrete, opening the switch (5) to deflate the airbag (8) and open the discharging port (7); releasing positional constraints, extracting the tubular storage and filling device for hydraulic mass concrete upward to form a cavity (12); simultaneously filling the ductile material (13) to the cavity (12) via the discharging port (7), achieving simultaneous tube extraction and cavity filling.

2. The use of the tubular storage and filling device for hydraulic mass concrete as claimed in claim 1, wherein an upper bearing plate (61) is further disposed above the airbag (8), a space for installing the airbag (8) is formed between the upper bearing plate (61) and the bottom sealing plate (6), and the upper bearing plate (61) is defined with a circulation port (611) adapted to the discharging port (7).

3. The use of the tubular storage and filling device for hydraulic mass concrete as claimed in claim 2, wherein a top of the inner tube body (2) extends above a top of the outer tube body (1), and a connecting rod (3) is connected between the outer tube body (1) and inner tube body (2).

4. The use of the tubular storage and filling device for hydraulic mass concrete as claimed in claim 3, wherein the supporting piece (w1) is of a linear or cross-shaped structure.

5. The use of the tubular storage and filling device for hydraulic mass concrete as claimed in claim 4, wherein the tubular storage and filling device for hydraulic mass concrete further comprises: a connecting piece (w2) and a pressing piece (w3):

the connecting piece (w2) comprises a pressure sleeve (w21), a top of the pressure sleeve (w21) is connected to a positioning sleeve (w22); the pressure sleeve (w21) is provided with an annular partition plate (w23), the annular partition plate (w23) is fixedly connected to an inner wall of the pressure sleeve (w21); a bottom of the pressure sleeve (w21) is defined with a latching notch (w24), and the latching notch (w24) is compatible and clamped with the top of the inner tube body (2); and the pressing piece (w3) comprises a cross brace (w31) threadedly connected to a threaded rod (w32), a bottom of the threaded rod (w32) is adaptively inserted into the positioning sleeve (w22); and a side wall of the pressure sleeve (w21) is defined with an opening (w211) configured to allow the gas pipe (4) to pass through.

6. The use of the tubular storage and filling device for hydraulic mass concrete as claimed in claim 1, wherein the ductile material (13) comprises rubberized concrete, acrylic-modified concrete, acrylic-modified rubberized concrete, rubberized mortar, and acrylic-modified rubberized mortar.

7. The use of the tubular storage and filling device for hydraulic mass concrete as claimed in claim 5, wherein the step S44 of detachably installing the tubular storage and filling device for hydraulic mass concrete comprises:

S44-1: installing the supporting piece (w1) at the design position and binding the supporting piece (w1) to the pier reinforcement (15) to form a lower limit foundation;

S44-2: placing the filling body (b) onto the supporting piece (w1), and making the slot (101) at the bottom of the outer tube body (1) engage with the supporting piece (w1);

S44-3: installing the connecting piece (w2) onto the top of the inner tube body (2); passing the gas pipe (4) through the opening (w211) of the pressure sleeve (w21);

S44-4: placing the cross brace (w31) above the connecting piece (w2) and temporarily binding the cross brace (w31) to the pier reinforcement (15); rotating the threaded rod (w32) downward to press into the positioning sleeve (w22) at a top of the connecting piece (w2), forming an upper limit foundation through cooperation of the pressing piece (w3) and the connecting piece (w2); and fixing the filling body (b) by the upper limit foundation and the lower limit foundation, thereby realizing positioning of the filling body (b) within the pier reinforcement (15).

* * * * *